US009388346B2

(12) United States Patent
Neumann et al.

(10) Patent No.: US 9,388,346 B2
(45) Date of Patent: Jul. 12, 2016

(54) REMOVAL OF HETEROAROMATIC SULFIDES FROM HYDROCARBONS USING POLYOXOMETALATES CATALYSTS

(75) Inventors: Ronny Neumann, Kfar Saba (IL); Alexander Khenkin, Rehovot (IL)

(73) Assignee: YEDA RESEARCH AND DEVELOPMENT CO. LTD., Rehovot (IL)

( * ) Notice: Subject to any disclaimer, the term of this patent is extended or adjusted under 35 U.S.C. 154(b) by 381 days.

(21) Appl. No.: 13/881,145

(22) PCT Filed: Oct. 31, 2011

(86) PCT No.: PCT/IL2011/000840

§ 371 (c)(1), (2), (4) Date: Apr. 23, 2013

(87) PCT Pub. No.: WO2012/059914

PCT Pub. Date: May 10, 2012

(65) Prior Publication Data

US 2013/0206646 A1 Aug. 15, 2013

Related U.S. Application Data

(60) Provisional application No. 61/408,678, filed on Nov. 1, 2010.

(51) Int. Cl.

| | |
|---|---|
| ***C10G 29/06*** | (2006.01) |
| ***C10G 27/10*** | (2006.01) |
| ***C10G 29/16*** | (2006.01) |

(52) U.S. Cl.

CPC ..... *C10G 29/16* (2013.01); *C10G 27/10* (2013.01); *C10G 29/06* (2013.01); *C10G 2300/104* (2013.01); *C10G 2300/1025* (2013.01); *C10G 2300/1044* (2013.01); *C10G 2300/1051* (2013.01); *C10G 2300/1055* (2013.01); *C10G 2300/1062* (2013.01); *C10G 2300/1085* (2013.01); *C10G 2300/1096* (2013.01); *C10G 2300/202* (2013.01)

(58) Field of Classification Search

CPC ..... C10G 2300/1025; C10G 2300/104; C10G 2300/1044; C10G 2300/1051; C10G 2300/1055; C10G 2300/1062; C10G 2300/1085; C10G 2300/1096; C10G 2300/202; C10G 27/10; C10G 29/06; C10G 29/16

See application file for complete search history.

(56) References Cited

U.S. PATENT DOCUMENTS

| | | | | |
|---|---|---|---|---|
| 6,723,349 | B1 | 4/2004 | Hill et al. | |
| 2007/0282138 | A1 * | 12/2007 | Richards et al. | 568/959 |
| 2010/0300938 | A1 * | 12/2010 | Martinie et al. | 208/236 |

OTHER PUBLICATIONS

Babich et al., (2003) "Science and Technology of Novel Processes for Deep Desulfurization of Oil Refinery Streams: a Review," Fuel, 82(6):607-631.

(Continued)

*Primary Examiner* — In Suk Bullock
*Assistant Examiner* — Derek Mueller
(74) *Attorney, Agent, or Firm* — Mark S. Cohen; Pearl Cohen Zedek Latzer Baratz LLP

(57) ABSTRACT

The present invention relates to methods of removing heteroaromatic sulfides from hydrocarbons (e.g. petroleum products such as gasoline and fuel oils), using polyoxometalate catalysts such as $H_5PV_2Mo_{10}O_{40}$ or solvates thereof.

20 Claims, 2 Drawing Sheets

(56) References Cited

OTHER PUBLICATIONS

Esser et al., (2004) "Deep Desulfurization of Oil Refinery Streams by Extraction with Ionic Liquids," Green Chem., 6(7):316-322.
Figueras et al., (2004) "Influence of the Coordination on the Catalytic Properties of Supported W Catalysts," Journal of Catalysis, 226(1):25-31.
Gislason, (2002) "Sulfur Removal," Hydrocarbon Engineering, 7(2):39-42.
Haimov et al., (2002) "Polyethylene Glycol as a Non-Ionic Liquid Solvent for Polyoxometalate Catalyzed Aerobic Oxidation," Chem. Commun., 8:876-877.
Hernandez-Maldonado et al., (2003) "Desulfurization of Commercial Liquid Fuels by Selective Adsorption via π-Complexation with Cu(I)-Y Zeolite," Ind. Eng. Chem. Res., 42(13):3103-3110.
Kabe et al., (1992) "Hydrodesulfurization of Sulfur-Containing Polyaromatic Compounds in Light Oil," Ind. Eng. Chem. Res., 31(6):1577-1580.
Khenkin et al., (2010) "Electron Transfer-Oxygen Transfer Oxygenation of Sulfides Catalyzed by the H5PV2Mo10O40 Polyoxometalate," J. Am. Chem. Soc., 132(33):11446-11448.
Khenkin et al., (2011) "Desulfurization of Hydrocarbons by Electron Transfer Oxidative Polymerization of Heteroaromatic Sulfides Catalyzed by H5PV2M010o40 Polyoxometalate," ChemSusChem, 4:346-348.
Kirimura et al., (2002) "Biodesulfurization of Naphthothiophene and Benzothiophene through Selective Cleavage of Carbon-Sulfur Bonds by *Rhodococcus sp*. Strain WU-K2R," Applied and Environmental Microbiology, 68(8):3867-3872.
Knudsen et al., (1999) "Catalyst and Process Technologies for Ultra Low Sulfur Diesel," Applied Catalysis A: General, 189(2):205-215.
Komintarachat et al., (2006) "Oxidative Desulfurization Using Polyoxometalates," Ind. Eng. Chem. Res., 45(6):1853-1856.
Ma et al., (1994) "Hydrodesulfurization Reactivities of Various Sulfur Compounds in Diesel Fuel," Ind. Eng. Chem. Res., 33(2):218-222.
Maayan et al., (2006) "Micelle Directed Synthesis of Polyoxometalate Nanoparticles and Their Improved Catalytic Activity for the Aerobic Oxidation of Sulfides," J. Am. Chem. Soc., 128(15):4968-4969.
Maurya et al., (2010) "Polymer-Bound Oxidovanadium(IV) and Dioxidovanadium(V) Complexes as Catalysts for the Oxidative Desulfurization of Model Fuel Diesel," Inorg. Chem., 49(14):6586-6600.
Neumann et al., (1989) "Aromatization of Hydrocarbons by Oxidative Dehydrogenation Catalyzed by the Mixed Addenda Heteropoly Acid H5PMo10V2O40," J. Org. Chem., 54(19):4607-4610.
Neumann et al., (2006) "Molecular Oxygen and Oxidation Catalysis by Phosphovanadomolybdates," Chem. Commun., 24:2529-2538.
Neumann, (2010) "Activation of Molecular Oxygen, Polyoxometalates, and Liquid-Phase Catalytic Oxidation," Inorg. Chem., 49(8):3594-3601.
Tsigdinos et al., (1968) "Molybdovanadophosphoric Acids and Their Salts. I. Investigation of Methods of Preparation and Characterization," Inorganic Chemistry, 7(3):437-441.
Zhang et al., (2009) "Photocatalytic Oxidation of Dibenzothiophene Using TiO2/Bamboo Charcoal," J Mater Sci, 44(12):3112-3117.

* cited by examiner

REMOVAL OF HETEROAROMATIC SULFIDES FROM HYDROCARBONS USING POLYOXOMETALATES CATALYSTS

CROSS-REFERENCE TO RELATED APPLICATIONS

This application is a National Phase Application of PCT International Application No. PCT/IL2011/000840, International Filing Date Oct. 31, 2011, claiming priority to and benefit of U.S. Provisional Application Ser. No. 61/408,678 filed on Nov. 1, 2010, the contents of which are herein incorporated by reference in their entireties.

FIELD OF THE INVENTION

The present invention relates to methods of removing heteroaromatic sulfides from hydrocarbons (e.g. petroleum products such as gasoline and fuel oils), using polyoxometalate catalysts such as $H_5PV_2Mo_{10}O_{40}$, or solvates thereof.

BACKGROUND OF THE INVENTION

The removal of sulfur containing compounds from petroleum products such as gasoline, diesel oil and jet fuel is an important part of the petroleum refining industry. Most sulfur containing compounds are removed by dehydrosulfurization (HDS) where $H_2$ gas is used to form hydrocarbons and $H_2S$.[1] Some sulfur containing compounds, in particular heteroaromatic sulfur derivatives such as dibenzothiophene and its alkylated derivatives are refractory towards HDS and require high reaction temperatures and pressures to be effective. Since environmental considerations and requirements mandate the removal of sulfur from fuels, so-called "deep" FIDS of refractory sulfur compounds is both difficult and expensive.

Thus, alternative "deep" desulfurization without $H_2$, or high pressure or temperature is desirable and in recent years, other techniques have been suggested to remove sulfur-containing compounds from commercial fuels. Such alternative techniques include (1) the relatively facile catalytic oxidation of sulfides by hydrogen peroxide or organic hydroperoxides such as tert-butylhydroperoxide to yield sulfones.[2,3] Numerous homogeneous and heterogeneous catalysts have been described in the literature for this reaction. The sulfones formed then need be removed from the fuel product by extraction, distillation, decomposition or adsorption. This approach is problematic since organic hydroperoxides are expensive and the use of hydrogen peroxide implies working with water that then requires careful drying of the fuel. Other approaches are (2) selective adsorption of refractory sulfides over solids such as Cu(I)—Y Zeolite,[4] or S Zorb SRT[5]; (3) selective extraction for example, using ionic liquids;[6] (4) biodesulfurization; and (5) photooxidation.[7]

There remains an unmet need for efficient methods for removing sulfide products from hydrocarbons, especially from petroleum products such as gasoline, fuel oils and the like.

SUMMARY OF THE INVENTION

The present invention relates to methods for removing heteroaromatic sulfides from hydrocarbon mixtures containing these sulfides (e.g., petroleum products such as crude oil, gasoline, fuel and the like). The methods involve contacting the hydrocarbons with a polyoxometalate catalyst such as $H_5PV_2Mo_{10}O_{40}$ or solvates thereof.

The inventors of the present invention have previously reported that polyoxometalate catalysts such as $H_5PV_2Mo_{10}O_{40}$ catalyze the electron transfer-oxygen transfer oxidation of sulfides, RSR' (R, R'=e.g., aryl, alkyl) to yield sulfoxides, RS(O)R'.[8,9] It was contemplated that the reactions take place by initial formation of a cation radical, RSR'+•, and a reduced polyoxometalate, $H_5PV^{V}V^{IV}Mo_{10}O_{40}$; RSR'+• is then oxygenated by oxygen transfer from the polyoxometalate. It has now been surprisingly found that heteroaromatic sulfides, e.g., thiophene derivatives such as benzothiophene (BT), dibenzothiophene (DBT), 4-methyldibenzothiophene (MDBT) and 4,6-dimethyldibenzothiophene (DMDBT) are not oxygenated to the corresponding sulfoxides, but rather can be oxidatively polymerized by polyoxymetalates such as $H_5PV_2Mo_{10}O_{40}$ and its solvates. In some preferred embodiments, the polyoxometalates are supported on an inert solid matrix such as silica or alumina. In other embodiments, the polymer formed is adsorbed or deposited onto the solid support and in this way these heterogeneous catalysts can be used to remove refractory heteroaromatic sulfides from hydrocarbons such as oil, gasoline or fuel products. Conveniently, the catalyst can be regenerated, e.g., by pyrolysis at high temperatures, e.g., 300-350° C. Using such methods, heteroaromatic sulfide derivatives can be aerobically and oxidatively polymerized over polyoxometalate catalysts so as to remove them from hydrocarbons down to non-detectable levels as analyzed by, e.g., gas chromatography with a flame photometric detector (GC-FPD).

Thus, in one embodiment, the present invention provides method for removing heteroaromatic sulfides from a hydrocarbon mixture comprising such sulfides, the method comprising the steps of (a) contacting the hydrocarbon mixture with a polyoxometalate catalyst or a solvate thereof so as polymerize the sulfides; and (b) separating the polymerized sulfides from the hydrocarbon mixture. In another embodiment, the present invention provides a method for polymerizing a heteroaromatic sulfide comprising the step of contacting the sulfide with a polyoxometalate catalyst or a solvate thereof.

In some embodiments, the polyoxometalate catalyst is supported by a solid support that can be, e.g., silica (such as $SiO_2$) or alumina (such as $Al_2O_3$). The polymerized sulfides are adsorbed or deposited onto the solid support and in such manner separated from the hydrocarbon mixture.

Polyoxometalate catalysts suitable for use in the present invention are typically polyoxoanion salt represented by the general formula $[X_xM_mO_y]^{q-}$ or a solvate thereof, wherein X is a metal or non-metal heteroatom, or a proton; M are addenda atoms selected from the group consisting of tungsten (W), molybdenum (Mo), niobium (Nb), vanadium (V), tantalum (Ta), bismuth (Bi), antimony (Sb), tin (Sn) and any combination thereof; O is oxygen; x is an integer between 0 and 6; m is an integer between 4 and 200; y is an integer between 5 and 1000; and q is an integer between 0 and 30. Non-limiting examples of such catalysts are provided hereinbelow. In a currently preferred embodiment, the polyoxometalate catalyst is $H_5PV_2Mo_{10}O_{40}$ In some embodiments, the polyoxometalate catalyst is not $H_3PMo_{12}O_{40}$. In other embodiments, the polyoxometalate catalyst is not $H_3PW_{12}O_{40}$.

Also, polyoxometalate catalysts are often in solvated forms, for example hydrates. Thus, the present invention encompasses the use of polyoxometalate solvates, such as but not limited to polyoxometalate hydrates. Each possibility represents a separate embodiment of the present invention.

Without wishing to be bound by any particular mechanism or theory, it is contemplated that the polymerization reaction is an electron transfer initiated oxidative polymerization of the heteroaromatic sulfide by the polyoxometalate. Thus, in one embodiment, the polyoxometalate catalyst is an oxidizing catalyst, i.e., it is able to transfer electrons from the heteroaromatic sulfides to the catalyst. An oxidizing catalyst preferably has a minimum oxidation potential, which can vary from catalyst to catalyst. An example of such an oxidizing catalyst is $H_5PV_2Mo_{10}O_{40}$ In some preferred embodiments, M is molybdenum (Mo) in a high valence state (i.e., +4, +5 or +6). In other preferred embodiments, M is tungsten (W) in a high valence state (i.e., +4, +5 or +6). In other embodiments, the catalyst may be reoxidized with molecular oxygen. Each possibility represents a separate embodiment of the present invention.

The applicants have found that, in general, molybdates (M=Mo) are more oxidizing than tungstates (M=W), but catalysts comprising both metals can be used in the context of the present invention. Furthermore, insertion of a transition metal such as cobalt can have a positive effect on the activity of the catalyst. For example, $Co(III)W_{12}O_{40}$ has been found to be active whereas $PW_{12}O_{40}$ (i.e., $H_3PW_{12}O_{40}$) is not.

In some embodiments, the hydrocarbon mixture is a petroleum product selected from the group consisting of crude petroleum oil, gasoline, diesel oil, fuel oil, jet fuel, kerosene, liquefied petroleum gas (LPG), lubricating oil, paraffin wax, petrochemicals, liquefied coal, gasified coal, liquefied oil shale, gasified oil shale derived from crude oil, coal, natural gas, oil shale, oil sands and tars, as well as mixtures and combinations thereof Each possibility represents a separate embodiment of the present invention. The nature of the heteroaromatic sulfide can vary. In some embodiments, the heteroaromatic sulfide is a thiophene derivative, a thiazole derivative or an isothiazole derivative. Examples of thiophene derivatives include, but are not limited to benzothiophene (BT), dibenzothiophene (DBT), 4-methyldibenzothiophene (MDBT) and 4,6-dimethyldibenzothiophene (DMDBT).

The ratio of catalyst relative to sulfide is preferably between about 1 equivalent of polyoxometalate catalyst to about 3-10 equivalents of sulfide. In one embodiment, the ratio of polyoxometalate to sulfide is about 1 equivalent of polyoxometalate to about 4-5 equivalents of sulfide.

BRIEF DESCRIPTION OF THE DRAWINGS

The present invention will be understood and appreciated more fully from the following detailed description taken in conjunction with the appended figures.

DETAILED DESCRIPTION OF THE PRESENT INVENTION

Figure 1:
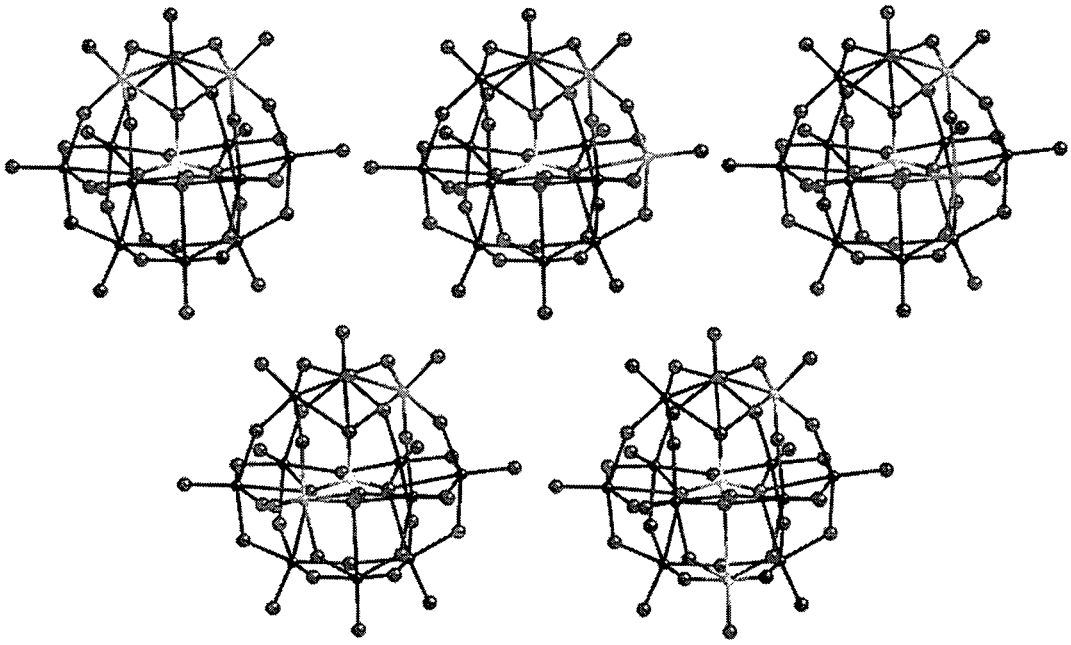
FIG. 1. Ball and stick representation of five non-limiting examples of isomers of $H_5PV_2Mo_{10}O_{40}$; the hydrogen cations or protons are not shown.

The present invention relates to compositions and methods for removing heteroaromatic sulfides from hydrocarbon mixtures containing these sulfides (e.g., petroleum products such as crude oil, gasoline, fuel and the like). The methods involve contacting the hydrocarbons with a polyoxometalate catalyst such as $H_5PV_2Mo_{10}O_{40}$ or solvates thereof. The catalyst may be supported on a solid support (e.g., silica or alumina). The sulfides are oxidatively polymerized and the so formed polymer is deposited or adsorbed onto the solid support, thereby separating the sulfides from the hydrocarbon mixture. The polymer-containing polyoxometalate-solid support matrix can then be separated from the hydrocarbon and the catalyst can conveniently be recycled for additional cycles of reaction.

Polyoxometalate Catalysts

A variety of polyoxometalate catalysts can be used in the methods of the present invention. In some embodiments, the catalysts are soluble polyoxoanion salts represented by the general formula $[X_xM_mO_y]^{q-}$ or a solvate thereof, wherein X is a metal or non-metal heteroatom, or a proton; M are addenda atoms selected from the group consisting of tungsten (W), molybdenum (Mo), niobium (Nb), vanadium (V), tantalum (Ta), bismuth (Bi), antimony (Sb), tin (Sn) and any combination thereof; O is oxygen; x is an integer between 0 and 6; m is an integer between 4 and 200; y is an integer between 5 and 1000; and q is an integer between 0 and 30. The catalyst is not One non-limiting class of polyoxometalate catalysts are Keggin compounds represented by the general formula $Q_q[XM_{12}O_{40}]$, or a solvate thereof, wherein X is selected from the group consisting of (i) B, Al, Ga, In, Si, Ge, Sn, P, As, Sb, S, Se, Te; (ii) a proton; and (iii) a transition metal selected from Sc, Ti, V, Cr, Mn, Fe, Co, Ni, Cu and Zn; M comprises tungsten (W), molybdenum (Mo) or combinations thereof (but can further comprise additional addenda atoms as defined above), wherein the tungsten and/or molybdenum are in a high valence state such as +4, +5 or +6; Q is a counter cation selected from a proton, an alkali metal, an alkaline earth metal, a transition metal including lanthanides or actinides, a main group metal, and an organic cation such as a quaternary ammonium or phosphonium cation; and q is an integer between 0 and 30. In some preferred embodiments, Q is a proton. In other preferred embodiments, X is phosphorous (P). In other preferred embodiments, X is Cobalt (Co). Each possibility represents a separate embodiment of the present invention. In one embodiment, the polyoxometalate catalyst is not $H_3PMo_{12}O_{40}$. In another embodiment, the polyoxometalate catalyst is not $H_3PW_{12}O_{40}$.

The Keggin structure has an approximate tetrahedral symmetry based on a central $XO_4$ tetrahedron surrounded by twelve $MO_6$ octahedra arranged in four groups of three edge shared octahedra, $M_3O_{13}$. Without wishing to be bound by any particular mechanism or theory, one may distinguish between four kinds of oxygen atoms: 4 internal oxygens connecting the heteroatom to the addenda, 12 edge sharing oxygens, 12 corner sharing oxygens connecting $M_3O_{13}$ units, and 12 terminal oxygens.

In some embodiments, the polyoxometalate catalyst is represented by the general formula $Q_q[XM_{12-n}M'_nO_{40}]$, or a solvate thereof, wherein X is selected from the group consisting of (i) B, Al, Ga, In, Si, Ge, Sn, P, As, Sb, S, Se, Te; (ii) a proton; and (iii) a transition metal selected from Sc, Ti, V, Cr, Mn, Fe, Co, Ni, Cu and Zn; M is selected from the group consisting of tungsten (W), molybdenum (Mo) and combinations thereof, wherein the tungsten and/or molybdenum are in a high valence state such as +4, +5 or +6; Q is a counter cation selected from a proton, an alkali metal, an alkaline earth metal, a transition metal including lanthanides or actinides, a main group metal, and an organic cation such as a quaternary ammonium or phosphonium cation; q is an integer between 0 and 30, M' selected from the group consisting of niobium (Nb), tantalum (Ta), antimony (Sb), bismuth (Bi), tin (Sn) and vanadium (V); and n is 0, 1, 2, 3, 4, 5 or 6. In other embodiments, the polyoxometalates are vanadium substituted molybdates represented by the formula $Q_q[XMo_{12-n}V_nO_{40}]$. Each possibility represents a separate embodiment of the present invention. In one currently preferred embodiment, the polyoxometalate catalyst is $H_5PV_2Mo_{10}O_{40}$ or a solvate thereof. In other embodiments, the polyoxometalate catalyst is not $H_3PMo_{12}O_{40}$In other embodiments, the polyoxometalate catalyst is not $H_3PW_{12}O_{40}$.

Polyoxometalate catalysts are often found in solvated forms, for example hydrates. Thus, the present invention encompasses the use of polyoxometalate solvates, such as but not limited to polyoxometalate hydrates. Other solvate molecules of polyoxometalate catalysts include, but are not limited to diethylether, acetonitrile, dimethylsulfoxide and tetrahydrofuran, solvates, as well as alcoholates (e.g., methanolates and ethanolates) and so forth. The amount of solvate molecules can vary from one to a few hundred. Each possibility represents a separate embodiment of the present invention.

A currently preferred solvated form is a hydrate. Thus, the polyoxometalate catalysts of the present invention may be in the form of a hemihydrate, hydrate, sesquihydrate, dihydrate, trihydrate, or multi-hydrate wherein the number of water molecules can be up to a few hundred. In some embodiments, the polyoxometalate catalyst is a hydrated form of $H_5PV_2Mo_{10}O_{40}$, such as $H_5PV_2Mo_{10}O_{40}x35H_2O$. Generally, the number of water molecules can range from about ½ to about 500 molecules of water. Each possibility represents a separate embodiment of the present invention. In one particular embodiment, the polyoxometalate is $H_5PV_2Mo_{10}O_{40}x35H_2O$. In another embodiment, the polyoxometalate catalyst is an oxidizing catalyst, i.e., it is able to transfer electrons from the heteroaromatic sulfides to the catalyst.

The polyoxometalate catalysts used in the methods of the present invention can exist in many isomeric forms, non-limiting examples of which are presented in FIG. 1. It is noted, however, that the polyoxometalate catalysts can exist in any other isomeric or geometric form.

In some embodiments, the catalyst is linked to a solid support so as to facilitate removal of the polymerized heteroaromatic catalyst by taking advantage of a heterogeneous catalyst system. The nature of the solid support is not particularly limiting. Some examples of solid support include, but are not limited to, silica (e.g., $SiO_2$), alumina (e.g., $Al_2O_3$), magnesia, titania, zirconia, montmorillonite, phyllosilicate, zeolites, talc, clays, layered double hydroxides, apatites, and the like. Each possibility represents a separate embodiment of the present invention. Also, combinations of these support materials may be used, for example, silica-chromium, silica-alumina, silica-titania and the like. In one particular embodiment, the solid support is silica ($SiO_2$). In another particular embodiment, the solid support is alumina ($Al_2O_3$).

The ratio of catalyst relative to sulfide is preferably between 1 equivalent of polyoxometalate catalyst to about 3-10 equivalents of sulfide. In one embodiment, the ratio of polyoxometalate to sulfide is about 1 equivalent of polyoxometalate to about 4-5 equivalents of sulfide. In another embodiment, the ratio of polyoxometalate to sulfide is about 1 equivalent of polyoxometalate to about 10 equivalents of sulfide. In another embodiment, the ratio of polyoxometalate to sulfide is about 1 equivalent of polyoxometalate to about 6 equivalents of sulfide. In another embodiment, the ratio of polyoxometalate to sulfide is about 1 equivalent of polyoxometalate to about 2 equivalents of sulfide. However, it should be apparent to a person of skill in the art that any ratio of catalyst to sulfide that appears appropriate to a person of skill in the art can be used in the context of the present invention.

Hydrocarbons:

A variety of hydrocarbons and hydrocarbon mixtures can be used in the context of the present invention. Basically any hydrocarbon which contains any amount of heteroaromatic sulfides can be used as a substrate for the methods of the present invention.

In some embodiments, the hydrocarbon mixture is a petroleum product. Non-limiting examples of petroleum products are crude petroleum oil, gasoline, diesel oil, fuel oil, jet fuel, kerosene, liquefied petroleum gas (LPG), lubricating oil, paraffin wax, petrochemicals, liquefied coal, gasified coal, liquefied oil shale, gasified oil, shale derived from crude oil, coal, natural gas, oil shale, oil sands and tars, and any combinations thereof. Each possibility represents a separate embodiment of the present invention.

Heteroaromatic Sulfides:

The term "heteroaromatic sulfide", as used herein, refers to a heteroaromatic system containing one or more sulfur atoms. The heteroaromatic system generally contains 5 or more ring atoms. The heteroaromatic system can be monocyclic, bicyclic, tricyclic and the like. Also included in this expression are the benzoheteroaromatic sulfide and dibenzoheteroaromatic sulfide derivatives. The nature of the heteroaromatic sulfide can vary. The heteroaromatic sulfide may contain, in addition to the sulfur, one or more additional heteroatoms such as O, N etc. In some embodiments, the heteroaromatic sulfide is a thiophene derivative, including benzothiophene and dibenzothiophene derivatives. In other embodiments, the heteroaromatic sulfide is a thiazole derivative, including benzothiazole derivatives. In other embodiments, the heteroaromatic sulfide is an isothiazole derivative, including benzoisothiazole derivatives. In other embodiments, the heteroaromatic sulfide is a thiadiazole derivative, including benzothiadiazole derivatives. In other embodiments, the heteroaromatic sulfide is a thiatriazole derivative, including benzothiatriazole derivatives.

The heteroaromatic sulfide may be unsubstituted or may be substituted by groups such as, but not limited to alkyl, aryl, alkylaryl, cycloalkyl, aryl, heterocyclyl, heteroaryl, halogen, hydroxy, alkoxy, aryloxy, alkylaryloxy, heteroaryloxy, oxo, phenyl, naphthyl, amino, alkylamino, arylamino, heteroarylamino, dialkylamino, diarylamino, alkylarylamino, alkylheteroarylamino, arylheteroarylamino, acyl, acyloxy, nitro, carboxy, carbamoyl, carboxamide, cyano, sulfonyl, sulfonylamino, sulfinyl, sulfinylamino, thiol, alkylthio, arylthio, or alkylsulfonyl groups.

Examples of thiophene derivatives include, but are not limited to thiophene, benzothiophene (BT), dibenzothiophene (DBT), 4-methyldibenzothiophene (MDBT) and 4,6-dimethyldibenzothiophene (DMDBT). Examples of thiazole derivatives include, but are not limited to thiazole, benzothiazole, and dibenzothiazole. Examples of thiadiazole derivatives include 1,2,3 thiadiazoles, 1,2,4 thiadiazoles, 1,2,5 thiadiazoles, 1,3,4 thiadiazolesand benzo-derivatives thereof. Examples of thiatriazole derivatives include 1,2,3,4 thiatriazole, 1,2,3,5 thiatriazole, and their benzo-derivatives thereof. Examples of isothiazole derivatives include, but are not limited to isothiazole, benzoisothiazole, dibenzoisothiazole and the like. Each possibility represents a separate embodiment of the present invention.

The process of the present invention can be used to remove small or large amounts of heteroaromatic sulfides from hydrocarbons. Thus, as little as 1 ppm or as much as 5,000 ppm or even more of heteroaromatic sulfide in a hydrocarbon mixture can be removed by the process of the present invention.

EXPERIMENTAL DETAILS SECTION

Example 1

Polymerization of benzothiophene

Benzothiophene (84 mM) was reacted with $H_5PV_2Mo_{10}O_{40}$ (30 mM) dissolved in acetic acid (1 mL) at 70° C. for 1 h. In contrast to a reaction using thioanisole as substrate,[9] no sulfoxide was formed but benzothiophene was almost completely consumed and a brown-black insoluble material was formed. Similarly mixing benzothiophene with $H_5PV_2Mo_{10}O_{40}$ at 22° C. yielded a green solution whose UV-vis spectrum indicated the formation of a reduced polyoxometalate, $H_5PV^{V}V^{IV}Mo_{10}O_{40}$. Without wishing to be bound by any particular mechanism or theory, it is contemplated that the polymerization reaction is an electron transfer initiated oxidative polymerization of the heteroaromatic sulfide by the polyoxometalate.

Example 2

Removal of Heteroaromatic Sulfides from Hydrocarbons

A heterogeneous catalyst, 10 wt % $H_5PV_2Mo_{10}O_{40}/SiO_2$ was prepared by wet impregnation. Thus, $H_5PV_2Mo_{10}O_{40}$ (1 gm) prepared according to the literature,[1] was dissolved in water (50 mL) and added to silica gel 60, (10 g, Merck, 0.040-0.063 mm, surface area 480-540 $m^2/g$) suspended in water (50 mL). The resulting mixture was stirred at RT for 2 h and the water was then evaporated under vacuum. $H_5PV_2Mo_{10}O_{40}/SiO_2$ was dried under reduced pressure for 2 h.

In order to test the effectiveness of $H_5PV_2Mo_{10}O_{40}$ for removal of refractory heteroaromatic sulfides from hydrocarbons, benzothiophene, dibenzothiophene or 4,6-dimethyldibenzothiophene dissolved in decane were used as model reaction mixtures. A typical reaction procedure for oxidative desulfurization was as follows: 100 mg 10% $H_5PV_2Mo_{10}O_{40}/SiO_2$, a known amount of sulfide, and 1 mL of decane were placed into 4 mL vial and stirred under air at the appropriate temperature. Analysis of the sulfides was carried out by gas chromatography with a flame photometric detector (GC-FPD) that has high sensitivity for sulfides using a 30 m, 0.32 mm i.d. 5% phenyl methylsilicone column with a 0.25 μm coating using He as eluent.

The results obtained using relatively concentrated solutions (1400 ppm) are presented in Table 1.

TABLE 1

Oxidative Polymerization of Heteroaromatic Sulfides (1400 ppm).

| Substrate | Catalyst | T, ° C. | t, h | Residual Sulfide, ppm |
|---|---|---|---|---|
| DBT | $H_5PV_2Mo_{10}O_{40}/SiO_2$ | 120 | 5 | 0.17 |
| DBT | $H_5PV_2Mo_{10}O_{40}/Al_2O_3$ | 120 | 5 | 0.25 |
| DBT | $H_5PV_2Mo_{10}O_{40}/SiO_2$ | 70 | 6 | 1.5 |
| DBT | $H_5PV_2Mo_{10}O_{40}/SiO_2$[a] | 120 | 5 | 950 |
| BT | $H_5PV_2Mo_{10}O_{40}/SiO_2$ | 120 | 5 | 0.38 |
| DMDBT | $H_5PV_2Mo_{10}O_{40}/SiO_2$ | 120 | 2 | 0.30 |

Reaction conditions: 100 mg 10% wt $H_5PV_2Mo_{10}O_{40}$ on support, 7.5 mmol substrate, 1 mL decane.
[a]10 mg catalyst.

The results show that using the preferred polyoxometalate, $H_5PV_2Mo_{10}O_{40}$, both on silica and alumina supports, sulfides can be polymerized effectively leaving behind sub-ppm amounts of the sulfides. The polymer formed has a brown-black color and covers the catalyst. In a preferred but non-limiting embodiment, the catalyst loading is relatively high relative to sulfide, for example about 4 to 5 equivalents of sulfide per polyoxometalate.

Advantageously, the $H_5PV_2Mo_{10}O_{40}/SiO_2$ catalyst can be recycled by pyrolysis of the solid under wet oxygen at 300-350° C. for 12 h. The activity of the catalyst is retained over the five cycles tested and the catalyst appeared to be stable, judging from IR spectroscopy.

Example 3

Removal of Small Amounts of Heteroaromatic Sulfides from Hydrocarbons

Figure 2:
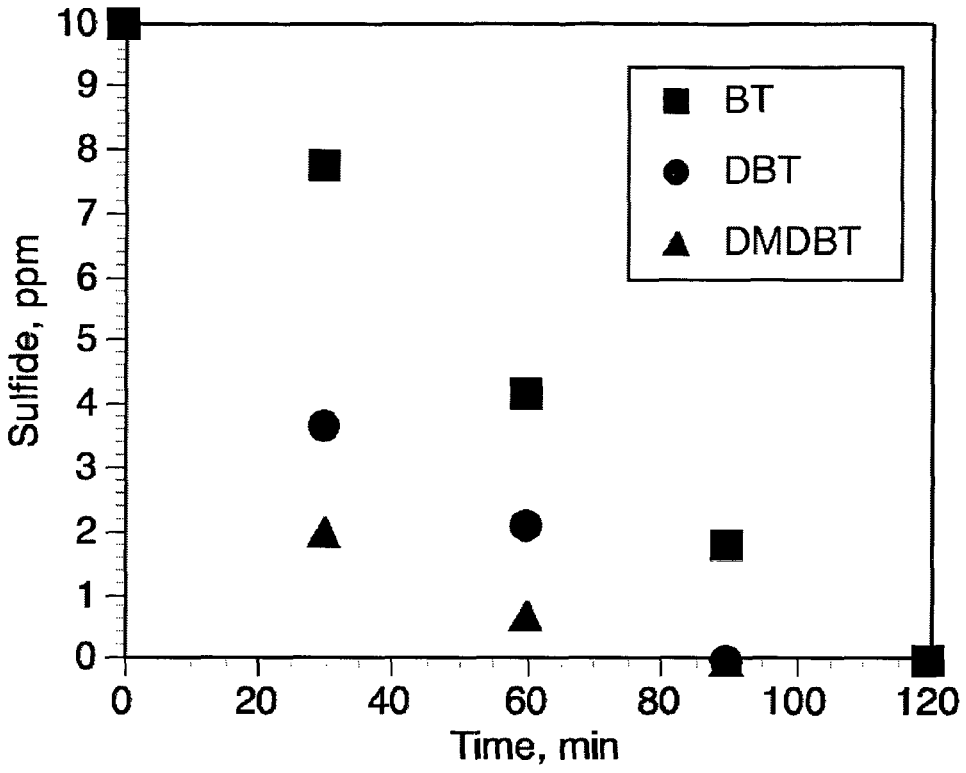
FIG. 2. Kinetic profile for the oxidative polymerization of a mixture of heteroaromatic sulfides. (Reaction conditions: 5.4 μmol each of benzothiophene (BT), dibenzothiophene (DBT), and dimethyldibenzothiophene (DMDBT), 100 mg 10% $H_5PV_2Mo_{10}O_{40}/SiO_2$, 1 mL decane, 70° C.)

The catalytic activity of $H_5PV_2Mo_{10}O_{40}/SiO_2$ for removal of relatively small amounts of heteroaromatic sulfides under mild conditions, e.g., 70° C., was tested on a mixture of 10 ppm each of benzothiophene, dibenzothiophene and 4,6-dimethyldibenzothiophene in decane. The kinetic profile of the disappearance of the sulfides from solution is presented in FIG. 2 (Reaction conditions: 5.4 μmol of BT, DBT and DMDBT each, 100 mg 10% $H_5PV_2Mo_{10}O_{40}/SiO_2$, 1 mL decane, 70° C.).

As demonstrated, the methods of the present invention are also applicable to the removal of low concentrations of heteroaromatic sulfides from solution even under very mild conditions.

Example 4

Removal of Heteroaromatic Sulfides from Gasoline

The ability of $H_5PV_2Mo_{10}O_{40}/SiO_2$ to remove heteroatomic sulfides from actual gasoline was also tested. Thus, 95 octane gasoline containing approximately 15 ppm sulfides was treated with catalyst as noted in the footnote of Table 1. All the sulfides were removed from the gasoline.

Thus, $H_5PV_2Mo_{10}O_{40}/SiO_2$ is a recyclable catalyst for the removal of heteroaromatic sulfides that are normally refractory to HDS, from hydrocarbons. It is contemplated that the reactions proceed by oxidative polymerization.

While certain embodiments of the invention have been illustrated and described, it will be clear that the invention is not limited to the embodiments described herein. Numerous modifications, changes, variations, substitutions and equivalents will be apparent to those skilled in the art without departing from the spirit and scope of the present invention as described by the claims, which follow.

REFERENCES

1. K. G. Knudsen, B. H. Cooper, and H. Topsoe, Appl. Catal., 1999, 189, 205; X. Ma, K. Sakanishi, and I. Mochida, Ind. Eng. Chem. Res., 1994, 33, 218; T. Kabe, A. Ishihara, and H. Tajima, Ind. Eng. Chem. Res., 1992, 31, 1577; I. V. Babach and J. A. Moulijn, Fuel, 2003, 82, 607.
2. M. R. Maura, A. Arya, A. Kumar, M. L. Kuznetsov, F. Avecilla, and J. C. Pessoa, Inorg. Chem., 2010, 49, 6586 and references therein.
3. F. Figueras, J. Palomeque, S. Loridant, C. Feche, N. Essayem, and G. Gelbard, J. Catal. 2004, 226, 25.
4. A. J. Hernandez-Maldonado, and R. T. Yang, Ind. Eng. Chem. Res., 2003, 42, 3103.
5. J. Gislason, Hydrocarbon Eng., 2002, 7, 39.

6. J. Esser, P. Wasserscheid, and A. Jess, Green Chem., 2004, 6, 316.
7. K. Kirimura, T. Furuya, R. Sato, Y. Ishii, K. Kino, and S. Usami, Appl. Environ. Microbiol., 2002, 68, 3867; J. Zhang, D. Zhao, J. Wang, and L. Yang, J. Mater. Sci., 2009, 44, 3112.
8. R. Neumann, Inorg. Chem., 2010, 49, 3594; R. Neumann and A. M. Khenkin, Chem. Commun., 2006, 2529.
9. A. M. Khenkin, G. Leitus and R. Neumann, J. Am. Chem. Soc., 2010, 132, 11446.
10. R. Neumann and M. Lissel, J. Org. Chem.,1989, 54, 4607.
11. G. A. Tsigdinos and C. J. Hallada Inorg. Chem., 1968, 7, 437.

What is claimed is:

1. A method for polymerizing a heteroaromatic sulfide comprising the step of contacting said sulfide with a polyoxometalate catalyst, or a solvate thereof; wherein said polyoxometalate catalyst is represented by the general formula $Q_q[XM_{12-n}M'_nO_{40}]$,
or a solvate thereof, wherein:

X is selected from the group consisting of (i) B, Al, Ga, In, Si, Ge, Sn, P, As, Sb, S, Se, Te; (ii) a. proton; and (iii) a transition metal selected from Sc, Ti, V, Cr, Mn, Fe, Co, Ni, Cu and Zn;

M is selected from the group consisting of tungsten (W), molybdenum (Mo) and combinations thereof, wherein the tungsten and/or molybdenum are in a high valence state, preferably +4, +5 or +6;

M' is selected from the group consisting of niobium (Nb), tantalum (Ta), antimony (Sb), bismuth (Bi), tin (Sn) and vanadium (V);

Q is a counter cation selected from a proton, an alkali metal, an alkaline earth metal, a transition metal which is preferably lanthanides or actinides, a main group metal, and an organic cation which is preferably a quaternary ammonium or phosphonium cation; n is 0, 3, 4, 5or 6; and q is an integer between 1 and 30.

2. The method according to claim 1, wherein said heteroaromatic sulfide is contained in a hydrocarbon mixture.

3. A method for removing heteroaromatic sulfides from a hydrocarbon mixture comprising said sulfides, the method comprising the steps of (a) polymerizing the heteroaromatic sulfide according to the method of claim 1; and (b) separating the polymerized sulfides from the hydrocarbon mixture.

4. The method according to claim 3, wherein the polyoxometalate catalyst is supported on a solid support and the polymerized sulfides are adsorbed or deposited onto the solid support to form a polymer-containing solid support.

5. The method according to claim 4, further comprising the step of separating the polymer-containing solid support from the hydrocarbon mixture.

6. The method according to claim 1, wherein the polyoxometalate catalyst is represented by the general formula $Q_q[XMo_{12-n}V_nO_{40}]$, or a solvate thereof.

7. The method according to claim 6, wherein X is P.

8. The method according to claim 7, wherein Q is a proton.

9. The method according to claim 8, wherein the polyoxometalate catalyst is $H_5PV_2Mo_{10}O_{40}$ or a solvate thereof.

10. The method according to claim 1, wherein the polyoxometalate is in the form of a solvate, selected from the group consisting of a hydrate containing between ½ and 500 molecules of water, a diethylether solvate, an acetonitrile solvate, a dimethylsulfoxide solvate, a tetrahydrofuran solvate, and an alcoholate, preferably methanolate or ethanolate.

11. The method according to claim 10, wherein said solvate of the polyoxometalate is represented by the formula $H_5PV_2Mo_{10}O_{40}\times 35H_2O$.

12. The method according to claim 1, wherein the polyoxometalate catalyst is an oxidizing catalyst.

13. The method according to claim 2, wherein said hydrocarbon mixture is a petroleum product which is selected from the group consisting of crude petroleum oil, gasoline, diesel oil, fuel oil, jet fuel, kerosene, liquefied petroleum gas (LPG), lubricating oil, paraffin wax, petrochemicals, liquefied coal, gasified coal, liquefied oil shale, gasified oil shale derived from crude oil, coal, natural gas, oil shale, oil sands and tars, as well as any mixtures thereof.

14. The method according to claim 1, wherein the hetero aromatic sulfide is a thiophene derivative, a thiazole derivative, an isothiazole derivative, a thiadiazole derivative, a thiatriazole derivative, or combinations thereof.

15. The method according to claim 14, wherein the hetero aromatic sulfide is a thiophene derivative selected from the group consisting benzothiophene (BT), dibenzothiophene (DBT), 4-methyldibenzothiophene (MDBT) and 4,6-dimethyldibenzothiophene (DMDBT).

16. The method according to claim 4, wherein the solid support is selected from the group consisting of silica, alumina , magnesia, titania, zirconia, montmorillonite, phyllositicate, zeolites, talc, clays, layered double hydroxides, apatites, and any combination thereof.

17. The method according to claim 16, wherein the solid support is $SiO_2$, $Al_2O_3$, or a combination thereof.

18. The method according to claim 1, wherein the ratio of polyoxometalate to sulfide is about one equivalent of polyoxometalate to about 3-10 equivalents of sulfide.

19. The method according to claim 3, further comprising the step of recycling said polyoxometalate catalyst.

20. The method according to claim 3, wherein step (a) is conducted in the presence of air.

* * * * *